United States Patent [19]

Petz

[11] 4,358,649

[45] Nov. 9, 1982

[54] ROTARY SWITCH

[76] Inventor: Günter Petz, Flachslanderstr. 8, Nürnberg D 8500, Fed. Rep. of Germany

[21] Appl. No.: 212,865

[22] Filed: Dec. 4, 1980

[30] Foreign Application Priority Data

Dec. 5, 1979 [DE] Fed. Rep. of Germany ..... 2948860

[51] Int. Cl.[3] ..... H01H 21/80; H01H 9/06; H01H 3/50

[52] U.S. Cl. ..... 200/153 L; 200/6 BB; 200/11 G

[58] Field of Search ..... 200/153 L, 153 LB, 155 R, 200/296, 336, 156, 11 G, 11 TW, 6 B, 6 BB

[56] References Cited

U.S. PATENT DOCUMENTS 2,796,474 6/1957 Glogau ..... 200/6 BB
3,770,926 11/1973 Wanner ..... 200/153 L
3,965,755 6/1976 Rosenberg et al. ..... 200/11 G
3,971,904 7/1976 Ward ..... 200/153 LB

*Primary Examiner*—Willis Little
*Attorney, Agent, or Firm*—Bacon & Thomas

[57] ABSTRACT

A rotary switch for insertion in switch panel openings includes a housing (1), knob (3), a detent body (2) for limiting the knob position in the housing, a variable position coupling (7), a switch controlling cam member (8) and spring contact switches (13) retained in fixed position in the housing. Switch followers (12') engage the cams (12) of the cam member (8) to operate the switches in predetermined sequence and modes that can be varied by varying the cam arrangement on the inner and outer surface of the cam member. The switch program can also be varied by varying the relative angular position of the knob relative to the cam member through the variable position coupling.

9 Claims, 5 Drawing Figures

ROTARY SWITCH

FIELD OF THE INVENTION

This invention relates to rotary switches that are adapted to be received in switch panel openings.

BACKGROUND OF THE INVENTION

Rotary switches of the general type similar to this invention are known to use rotatable cams to actuate spring switches within a switch housing that is insertable within a panel opening. Such rotatable cams are usually axially offset to operate the switch mechanism. Moreover, such switches use detents to hold the switch knob and the cams in a set position. However, such switch units are not usually programmable, whereby the same setting of the knob can effect various switching functions, depending upon the relative orientation of the detent mechanism and the camming member. In addition, prior art switches require great structural length to accommodate the various operative elements.

BRIEF SUMMARY OF THE INVENTION

The rotary switch in accordance with this invention is provided with a switch controlling rotary cam member connected to the switch detent mechanism through a releasable variable position coupling that normally locks the knob and the cam member together for rotary movement. The coupling can be axially displaced against a spring force to disengage the detent from the cam member and to permit the latter to be repositioned in an angular sense relative to the former so that the switch program can be altered without changing the knob positions. The switch cam, variable position coupling, detent and knob are all axially spaced along the longitudinal axis of the switch housing, along with the switches themselves, including their cam follower elements which extend axially into the path of movement of the switch cams. The switch cam member is preferably a single annular molded member having cam surfaces on its inner and/or outer surfaces and a central projecting socket that engages a projection on the releasable coupling whereby the two elements are connected together in rotary driving relationship.

The variable position coupling includes radial projections that releasably engage radial grooves or switches in the switch detent body, which is directly connected to the switch knob. The coupling is releasably secured to the detent at one end and to the cam member at its other end.

Thus, by suitable arrangement of cams and switches, in combination with the variable position coupling, various switch programs can be arranged and subsequently modified, using the same switch elements, and without changing the position of the knob relative to the switch housing.

BRIEF DESCRIPTION OF THE DRAWINGS

A preferred embodiment of the invention is illustrated in the attached drawings, where.

DESCRIPTION OF THE PREFERRED EMBODIMENT OF THE INVENTION

Figure 1:
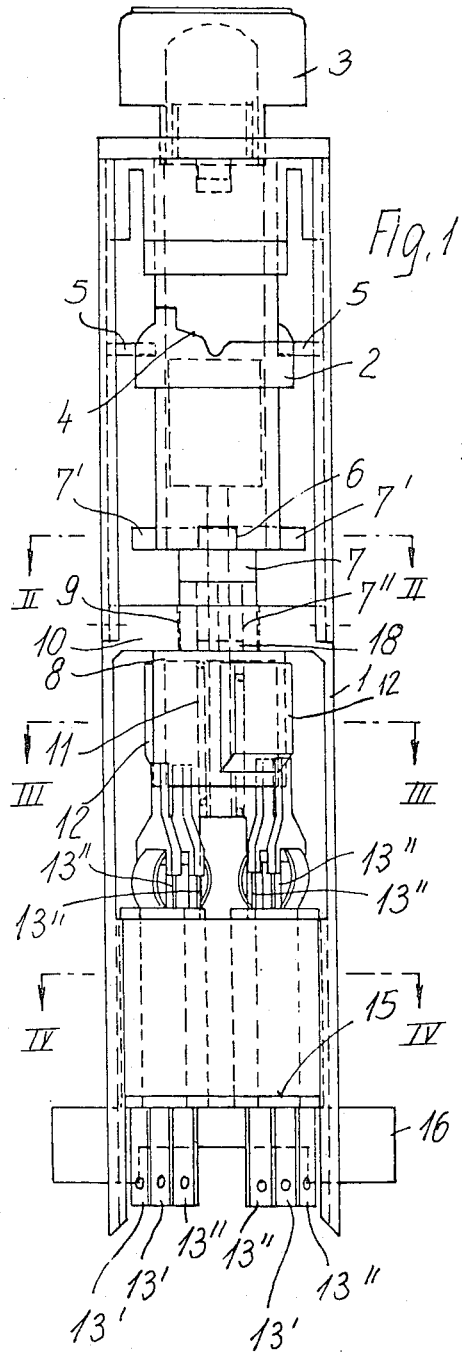
FIG. 1 is a partial cutaway side elevation view of a rotary switch incorporating this invention.

A rotary switch embodying this invention includes an elongated housing 1 which encloses a rotary detent body 2 axially spaced from and connected for rotation with a manipulable switch controlling knob 3. Detent body 2 includes detent surfaces 4 which cooperate with fixed pins 5 in housing 1 to releasably hold knob 3 in a set position.

Figure 2:
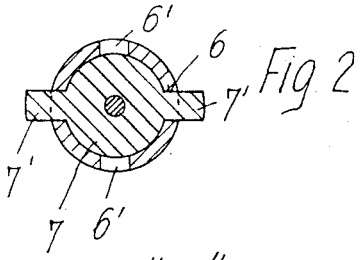
FIG. 2 is a section view taken along line II—II of FIG. 1.

A releasable variable position coupling member 7 with radial projections 7' is axially aligned with the detent body 2 and connected thereto by means of radial grooves 6, 6' which are selectively engageable with the projections 7', as shown in FIG. 2. The coupling 7 can be axially moved away from and rotated relative to grooves 6, 6' in detent body 2 to adjust the angular relationship between the knob 3 and the coupling 7. The connected grooves and projections between detent body 2 and coupling 7 constitute a releasable coupling means between the elements. A pin 2' axially extends through the coupling 7 and below a partition 10 in housing 1.

An annular switch controlling cam member 8 is coaxially retained in housing 1 about pin 2' by spring 11 which biases the cam member 8 upwardly against the partition 10. The cam member 8 has an axial square socket 18 which receives axial projection 7'' of the coupling member 7 to secure the cam member 8 and coupling 7 in torque transmitting relationship. The interconnection between coupling 7 and cam member 8 can be frictional if desired. Thus, it can be seen that the switch controlling cam member 8 is normally held in rotary driving relationship with knob 3 and detent body 2 through the coupling 7, but that, by axially moving the cam member 8 and coupling 7 downwardly against the force of the spring 11 and rotating the cam member 8 and coupling 7 90° relative to the detent body 2, the angular relationship between knob 3 and cam member 8 can readily be adjusted (in 90° increments in this embodiment).

Figure 3:
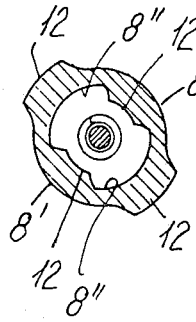
FIG. 3 is a section view taken along line III—III of FIG. 1.
Figure 5:
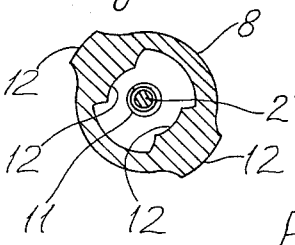
FIG. 5 is an alternate embodiment of the structure shown in FIG. 3.

The annular cam member 8 in this embodiment is preferably a unitary molded member that includes cams 12 in the form of projections extending outwardly or grooves extending inwardly from the respective inner and outer peripheral surfaces of the member 8 in circumferential spaced relationship. The cam member 8 preferably is formed from a synthetic resin such as thermoplastic or duroplastic material, and the inner and outer cams 12 may alternatively be radially opposite each other (FIG. 5) or circumferentially spaced from each other (FIG. 3).

Figure 4:
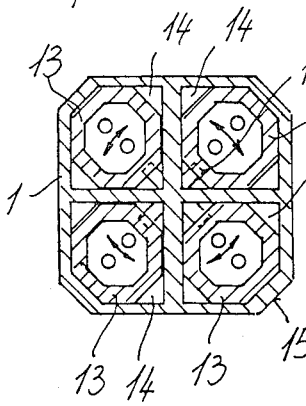
FIG. 4 is a section view taken along line IV—IV of FIG. 1.

Switch elements 13 extend through orifices 14 in a retainer plate 15 fixed to the housing (FIG. 4). The switches 13 are held on projection 17 (FIG. 4) that are fixed to the housing 1 by a stay member 16 that is inserted beneath the switches 13. The switches 13 include connector leafs 13' and spring switch contacts 13''. Cam followers 12' extend axially above the switches 13 in a generally circular array in a position to engage cams 12, whereby rotary motion of cam member 8 actuates various switches 13, which may be connect/disconnect, reversing or other types of switches. By means of the detent member 2, the releasable coupling 7, and the arrangement of cam surfaces 12, the program of actuation of the switches 13 can be varied without altering the limit of motion of knob 3 or its orientation relative to the housing 1.

It will be understood that various modifications within the ability of a skilled mechanic can be made to the preferred embodiment without departing from the present invention, the scope of which is defined in the following claims.

I claim:

1. In a rotatable switch adapted to be installed in a switch panel opening, the switch including a rotatable knob, an elongated housing, a rotatable annular detent body within the housing and connected to the knob in axially spaced relationship, the detent body cooperating with at least one detent element attached to the housing for frictionally holding the knob and the detent body at a set angular position and limiting its total angular motion, an annular rotatable cam member cooperating to open and close spring switch circuit elements, said spring switch circuit elements supported by a switch retainer within said housing and being axially spaced from said rotatable cam member, the improvement comprising:

said cam member being connected to said rotatable detent body in coaxially spaced relationship for rotation therewith, said cam member having switch controlling cams on at least a portion of its surface area and being connected to said detent body through a releasable variable position connection, said spring switch circuit elements including cam follower portions engageable with said cams for controlling the opening and closing of the switch elements when the cam member is rotated, whereby adjustment of the angular relationship between said cam member and said detent body can be carried out.

2. A rotatable switch as in claim 1, the further improvement comprising said releasable variable position connection comprising a coupling member connected to said cam member through a releasable joint connection arranged to cause the coupling and cam members to normally rotate in unison when the coupling member is in the non-released position.

3. A rotatable switch as claimed in claim 1 or 2, the further improvement comprising said releasable variable position connection including radial projections, said detent body including radial grooves, said projections axially engaging said grooves to cause the variable position connection and detent body to rotate in unison and being releasable from each other to permit adjustment of their angular relationship.

4. A rotary switch as claimed in claim 2, the further improvement comprising spring biasing means for urging said cam member into driving engagement with said coupling member.

5. A rotary switch as claimed in claim 1, the further improvement comprising said cams being located on the outer periphery of said annular cam member.

6. A rotary switch as claimed in claim 1, the further improvement comprising said cams being located on the inner periphery of said annular cam member.

7. A rotary switch as claimed in claim 1, the further improvement comprising switch controlling cams on the inner and outer peripheral areas of said annular cam member, the respective cams on the inner and outer peripheral areas arranged in radially opposed positions on said cam member.

8. A rotary switch as claimed in claim 1, the further improvement comprising said cams being disposed on the inner and outer peripheral areas of said cam member, the cams on the inner peripheral area being circumferentially spaced with respect to the cams on the outer peripheral area of said cam member.

9. A rotary switch as claimed in claim 1, the improvement further comprising said cam member comprising a unitary molded member formed of synthetic resin material.

* * * * *